United States Patent [19]

Harvey et al.

[11] Patent Number: 5,034,737

[45] Date of Patent: Jul. 23, 1991

[54] MAGNETIC FLEX CORE MECHANISM AND METHOD FOR MAKING SAME

[75] Inventors: George H. Harvey, Winsted; John J. Dean, Oxford, both of Conn.

[73] Assignee: Minelco Inc., Thomaston, Conn.

[21] Appl. No.: 179,618

[22] Filed: Apr. 8, 1988

[51] Int. Cl.[5] ..... G09G 3/00

[52] U.S. Cl. ..... 340/815.24; 340/815.26; 40/449

[58] Field of Search ..... 340/763, 764, 783, 815.08, 340/815.31, 815.04, 815.05, 815.24, 815.25, 815.26, 815.27; 40/446, 449; 336/20, 221, 212, 234

[56] References Cited

U.S. PATENT DOCUMENTS

| | | | |
|---|---|---|---|
| 2,885,646 | 5/1959 | Bugg | 336/234 |
| 3,623,083 | 11/1971 | Fessler et al. | 340/815.05 |
| 3,916,403 | 10/1975 | Mandzsu et al. | 340/815.04 |
| 4,547,962 | 10/1985 | de Walle et al. | 324/240 |
| 4,719,422 | 1/1988 | de Walle et al. | 324/238 |

FOREIGN PATENT DOCUMENTS

| | | | |
|---|---|---|---|
| 0019225 | of 1892 | United Kingdom | 340/815.08 |
| 752013 | 7/1956 | United Kingdom | 336/20 |
| 1454707 | 11/1976 | United Kingdom | 40/449 |

*Primary Examiner*—Jeffery A. Brier

*Attorney, Agent, or Firm*—Pennie & Edmonds

[57] ABSTRACT

A flexible electromagnet and a method for producing such are disclosed, the flexible electromagnet having a flexible magnetic core which permits directing the magnetic flux as desired. The core is constructed from a sufficiently flexible material such as cold rolled steel annealed to increase its flexiblity. A wire winding is wound on the core which is configured to be straight. Once the winding is complete, the core may be configured and reconfigured as desired. Particularly advantageous uses are in status indicators, especially miniature status indicators.

20 Claims, 3 Drawing Sheets

MAGNETIC FLEX CORE MECHANISM AND METHOD FOR MAKING SAME

TECHNICAL FIELD

This relates generally to electromagnets and more particularly to an electromagnet having a flexible core member upon which wire is wound. An especially useful implementation is in miniaturized indicating devices for indicating conditions such as mechanical or electrical failure in equipment such as aircraft, space vehicles, electronic systems and the like.

BACKGROUND OF THE INVENTION

Binary electromagnetic indicators providing non-illuminated contrasting color indicia are known by those skilled in the art and find utility in a variety of installations, e.g., aircraft, portable electronic equipment, computers, etc. Such indicators are often preferred over illuminated indicators as, for example, those using glow tubes or bulbs where the ambient light conditions make it difficult to distinguish the display from the surrounding background. Electromagnetic indicators are also preferred for installations that are subject to shock or where changes in ambient temperature are significant enough to accelerate deterioration of glow tubes and the like.

Illustrative prior art forms of binary electromagnetic indicators are disclosed in U.S. Pat. No. 704,462 to Pihl and U.S. Pat. No. 4,115,769 to Hart et al. These patents each disclose an electromagnetic indicator which is responsive to a fault or malfunction condition, whereby one of a pair of cooperating indicator members, each of which is disc-shaped and mounted along a common axis, rotates relative to the other to change a visual display. Both of the indicator members have a plurality of sectors of like size. The sectors of the stationary indicator member are alternately transparent and opaque, while the sectors of the movable indicator member are totally opaque although alternately distinguishable. In these patents the alternate sectors of the movable indicators are white and dark and the opaque sectors of the stationary indicator member are also dark. For example, the dark sectors of both indicator members may be colored with a black paint. Thus, in one position, the "set" position, the black sectors of the movable indicator member align with black sectors of the stationary indicator member and the white sectors of the movable indicator member align with transparent sectors of the stationary indicator member. In the position to which the movable indicator member moves as a result of a fault or malfunction condition, the opposite alignment will be seen. An alignment of the sectors of the movable indicator member also may be employed such that in the "set" position its black sectors align with the transparent sectors of the stationary indicator member.

U.S Pat. No. 4,652,868 to Hart discloses an indicator responsive to a fault signal in a monitored channel which provides an indication of the occurrence of a fault and an electrical interface to assure that the indicator will respond to the fault signal even if the fault signal is of an extremely short time duration. Either a single indicator or a plurality of indicators to respond to a plurality of channels to be monitored may be controlled by the electrical interface that functions to respond to an input fault signal and latch that signal for the duration of time required to permit the indicator to indicate the fault. The latch which may function as an AND gate provides a continuous enabling voltage output. A switch in the form of a transistor array, activated by an output of the latch, permits current to flow from a source, through a "set" coil of the indicator, to energize the particular indicator and provide a fault indication for the channel being monitored. The electrical interface also includes a circuit to "reset" the indicator and to "reset" the latch that shall have responded to the fault signal.

Known electromagnetic indicators have been found to suffer from a number of disadvantages. These disadvantages relate to the complexity of structure, the costs of fabrication, magnetic flux leakage as well as the physical size of the device and the degree of precision to which various components must be manufactured.

The above-described prior art devices as well as numerous other known devices employ an electromagnet which is energized by an electrical signal such as a fault signal. Such an electromagnet typically comprises a rigid fixed core and a wire wound coil which is formed by winding a wire or wires onto the rigid fixed core. Alternatively, wire may be wound onto a bobbin which is subsequently inserted onto a central rigid fixed core. The rigid fixed core may take on a wide variety of configurations such as a straight rod member, a U-shaped member, a C-shaped member, an L-shaped member, etc. However, regardless of the specific configuration, it is desirable to minimize flux leakage while producing high ampere turns and low operational power. In an illustrative magnetic system comprising a stationary C-shaped electromagnet having poles at each of its two ends and a rotor mounted so as to rotate within the area between the two pole pieces, magnetic flux leakage may be minimized by decreasing the air gap between the rotor and the pole pieces. Moreover, magnetic flux leakage can generally be minimized and efficiency increased by decreasing air gaps in magnetic circuits, whether the magnetic circuit is part of a motor or not.

Unfortunately, in order to decrease such air gaps, the pole piece or pieces must physically be in a very close relationship with any other element defining the air gap. In practice, however, this is not easy to achieve due to imprecise manufacturing tolerances which may lead to excessive air gaps or to direct physical contact between stationary pole pieces and a rotating member, especially in the case of C-shaped and U-shaped electromagnets. Furthermore, it is desirable, from a manufacturing point of view, to provide a single electromagnet which could be used in a wide variety of magnetic circuits to take advantage of the individual magnetic circuit configurations and reduce flux leakage.

Another disadvantage of prior art devices relates to the difficulty associated with winding wire onto rigid fixed cores which are not simple straight rod members. For example, it is often desirable to construct a horseshoe or U-shaped electromagnet by winding wire onto a U-shaped rigid fixed core. Unfortunately, in practice this is quite difficult to accomplish manually and even more difficult, if not impossible, to accomplish automatically by automatic wire winding machines. As a result, U-shaped electromagnets are sometimes only wound with wire along a straight section of the U-shaped member. However, this is also difficult and unnecessarily limits the amount of magnetic flux obtainable from the U-shaped member.

A further disadvantage of prior art devices relates to the loss of magnetic flux due to the staking together of structural members to create the C-shaped, L-shaped, U-shaped, etc. rigid fixed cores. Such structural members are generally staked together by rivets or similar fastening means, leading to a leakage of magnetic flux which could otherwise be beneficially employed. Although staking together of structural members after one or some of the members have been wound with wire may solve the problem of winding wire on the entire curved rigid core, this process unfortunately results in increased magnetic flux loss.

SUMMARY OF THE INVENTION

This relates to a flexible electromagnet for selectively directing magnetic flux comprising a flexible magnetically permeable core means which transmits magnetic flux and has a plurality of pole pieces and a coil means which creates magnetic flux and which is connectable to a line means. The coil means preferably is a plurality of wire turns formed on the core means. The line means may be a monitored line or channel in the case of fault or status detection or a power supply in the case of an electromagnet for use with a motor, or any of a wide variety of lines transmitting electrical signals. The electromagnet is sufficiently flexible so as to enable it to be bent into and retain any desired configuration by the application of finger pressure, allowing one to direct the magnetic flux emanating from any of the pole pieces to a desired location.

The flexible electromagnet preferably includes a covering layer on the core means and disposed between the core means and the coil means. This layer covering may be, for example, a polyester layer or a conformal layer and is provided to prevent abrasion of the insulation on the wire coil.

The core means of the flexible electromagnet may be a single flexible elongated core member having a first pole piece located at a first end of the core member and a second pole piece located at a second end of the core member. The core means may be constructed from a wide variety of sufficiently flexible materials such as cold rolled steel which has been annealed to increase its flexibility. Preferable forms of the core include elongated flat strips having rounded edges, round wire structures and round wire structures which has been flattened.

The coil means of the flexible electromagnet may be a single wire which is wound onto the core member, forming a number of wire turns around the core member. The coil means may be wound onto the core member along its entire length or, alternatively, only half the length or any desired portion of the length of the core.

In one especially advantageous use of the above-identified device, a housing means is also provided for housing the device and a permanent magnet is provided for indicating the status of the line to which the coil means is attached.

The permanent magnet is operatively associated with the electromagnet and in communication with the electromagnet by way of magnetic flux. The permanent magnet responds to energization of the electromagnet by rotating. In this particular embodiment, the permanent magnet is diametrically polarized and axially rotatably mounted within the housing so as to rotate with respect to the electromagnet. The diametrically polarized permanent magnet may be constructed from any of a number of suitable permanent magnet materials and is preferably constructed from barium ferrite. In this embodiment, the first pole piece and the second pole piece are positioned on opposite sides of the permanent magnet. Magnetic flux thus emanates from one pole piece, passes through the permanent magnet and enters the other pole piece.

A transient surge suppression network may be provided to suppress transient surges arising out of the inductance of the coil means. Such a network preferably comprises a zener diode connected in parallel with the coil means.

This invention also relates to an indicator device for monitoring an electrical channel and providing an indication of a status change signal on the channel. This particular device comprises a flexible magnetically permeable core member which has a first pole piece located at one end of the core member and a second pole piece located at an opposite end of the core member; a coil of wire wound onto at least a portion of the core member, the coil of wire terminating in two wire leads which are connectable to the channel to be monitored; a permanent magnet which is operatively associated with the core and the coil and which is in communication with the core and the coil by way of magnetic flux and which is responsive to energization of the coil; and a housing means for housing the core member, the coil of wire and the permanent magnet. In this illustrative device the core member is in the form of a U-shaped member with the first pole piece and the second pole piece positioned on opposite sides of the permanent magnet. The core and the coil are sufficiently flexible to enable them to be bent into the U-shaped configuration from a straight configuration by the application of finger pressure or the like. This enables magnetic flux to be selectively directed and such flux is preferably directed so as to emanate from one of the pole pieces and pass through the permanent magnet and into the other pole piece so as to produce rotation of the permanent magnet upon detection of a status change signal.

A transient surge suppression network is also provided for this device to suppress transient surges arising out of the inductance of the coil means and comprises a zener diode connected to the two wire leads and in parallel with the coil of wire.

A covering layer is preferably provided on the core member and is disposed between the core member and the coil of wire.

The coil of wire may be wound onto the core member along its entire length or, alternatively, only half the length or any desired portion of the length of the core.

As noted, the core member may be constructed from a wide variety of sufficiently flexible materials such as cold rolled steel which has been annealed to increase its flexibility. Preferable forms include elongated flat strips having rounded edges, round wire structures and round wire structures which have been flattened.

The permanent magnet in this particular embodiment is axially polarized and rotatably mounted so as to rotate with respect to the core and the coil in close proximity to the two pole pieces. The axially polarized permanent magnet may be constructed from any suitable permanent magnet material and is preferably constructed from barium ferrite.

The present invention also relates to a method for producing a flexible electromagnet comprising the steps of forming an elongated flexible magnetically permeable core member, winding a wire onto at least a portion of the elongated flexible core member and bending the elongated flexible core member having the wire wound thereon into a desired configuration. The core member in the desired configuration advantageously may be repeatedly reconfigured by bending the core member having the wire wound thereon. The steps of forming may comprise annealing cold rolled steel and the winding may be performed by an automatic winding machine. The bending step may comprise applying finger pressure to the core member or, alternatively, may comprise mechanical means applying pressure to the core member.

BRIEF DESCRIPTION OF THE DRAWINGS

These and other objects, features and advantages of the invention will be more readily apparent from the following detailed description of the invention in which identical elements are labelled similarly and in which.

DETAILED DESCRIPTION OF THE INVENTION

Figure 1:
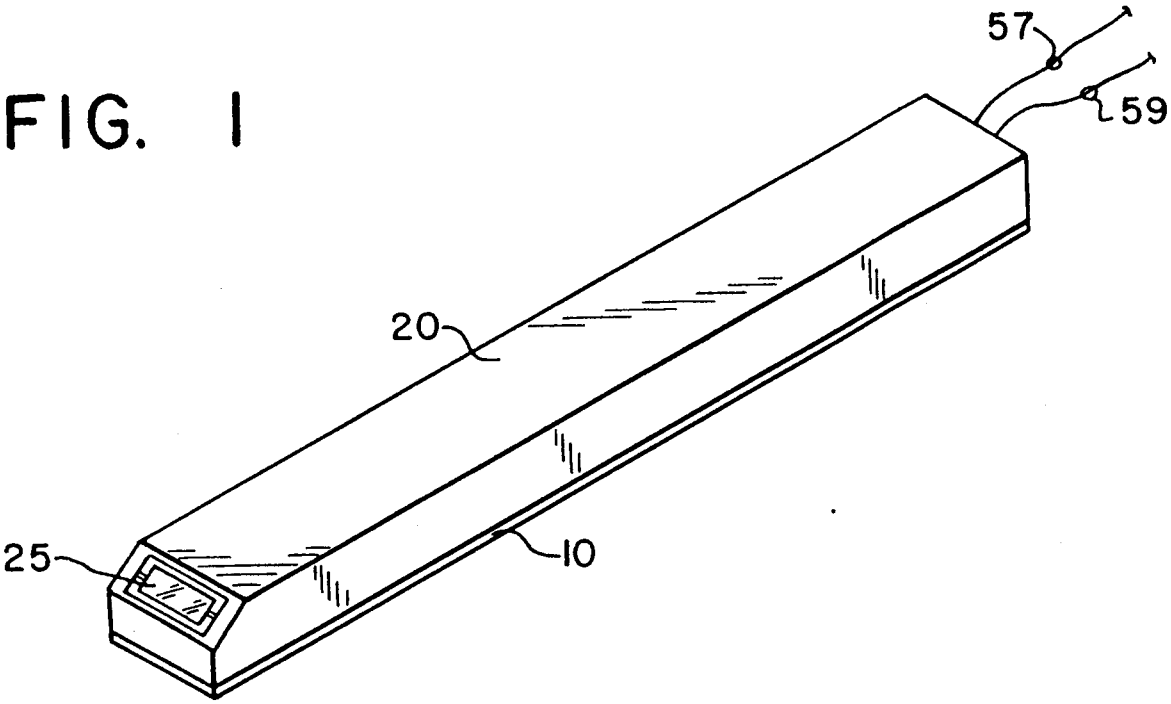
FIG. 1 is a perspective view of a first embodiment of the invention incorporating a flex core and a transient protection circuit.

Referring to FIGS. 1–4, there is depicted a first embodiment of the invention comprising a base 10, a housing 20, a housing window 25, an indicator display support 30, an indicator display 40 and a flexible electromagnet 50.

Base 10 and housing 20 are preferably constructed from a non-magnetically permeable material which has the characteristics of strength, rigidity and impact resistivity, such as a high strength plastic. Base 10 and housing 20 may be attached to each other with any suitable adhesive such as epoxy. Housing 20 is provided with a transparent housing window 25 located at a viewing end of the device. Housing window 25 provides a means for a viewer to view the state of the indicator and may be constructed from clear plastic and installed in housing 20. Alternatively, housing 20 may be constructed from clear plastic and subsequently painted, except for an area defining housing window 25 which area is unpainted.

Figure 3:
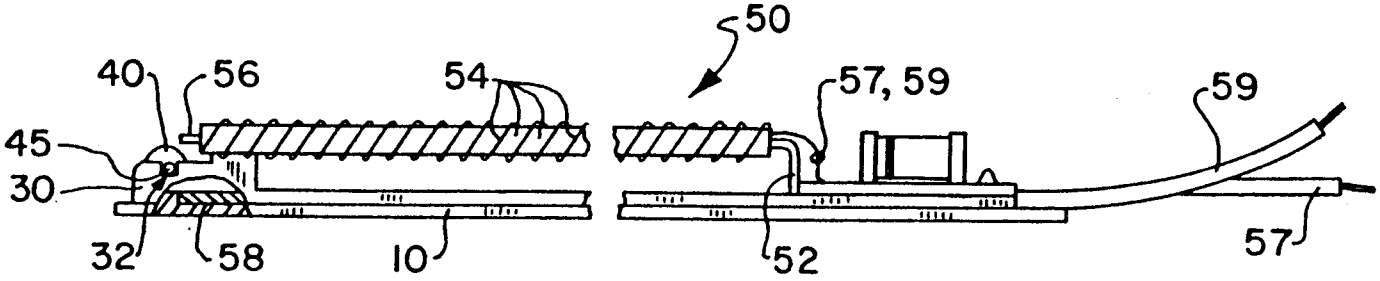
FIG. 3 is a side elevation view of the device of FIG. 1.

Indicator display support 30, as more clearly seen in FIG. 3, comprises two side members each having a notch 32 adapted to receive a rotating member.

Indicator display 40 comprises a rotatably mounted diametrically polarized cylindrical permanent magnet. Indicator display pin 45 rotatably supports indicator display 40 in notches 32 of each of the side members of indicator display support 30. Alternatively, a bearing or shaft arrangement or any suitable support means may be employed to attach indicator display 40 to indicator display support 30 and permit rotation of the indicator display. A longitudinal section corresponding to either the North pole section or the South pole section of magnetic display 40 is preferably painted a bright color, such as orange, or otherwise visually distinguished from the opposite pole section.

Indicator display 40 is preferably diametrically polarized and may be constructed from any known magnetic material such as alnico or barium ferrite or a wide variety of other materials. A permanent magnet constructed of ceramic barium ferrite has been found especially useful. The North and South poles of magnetic display 40 are preferably separated by 180°.

Flexible electromagnet 50 comprises a flexible core section 52 and a wire winding 54. Flexible core section 52 has associated therewith a first pole 56 and a second pole 58 located at opposite ends of core section 52.

Flexible core section 52 may be constructed from any sufficiently flexible magnetically permeable material such as ferrous steel and is preferably constructed from what is referred to in the art as AISI standard 1010 or 1008 steel. Cold rolled steel which has been annealed so as to increase its flexibility has been found acceptable. An especially useful form of core section 52 is a flat strip or wire form. The dimensions of the flexible core section will be dictated by the particular implementation and use. In the illustrative embodiment of FIGS. 1–4, flexible core section is approximately 10 mils×80 mils×3 ½ inches, prior to trimming. Subsequent to formation of the winding on core section 52 and prior to assembly, the two tip end sections of the core are trimmed to yield a core of length approximately 3 3/16 inches. These tip end section(s) may be used to physically retain the core while the wire is wound by an automated winding machine.

Flexible core section 52 may also take on a wide variety of shapes, depending on where it is desired to place the pole pieces and therefore magnetic flux flow. In the illustrative embodiment of FIGS. 1–4, the flexible core section is a narrow U-shaped structure, with the two pole pieces on opposite sides of and in close proximity to the indicator display. However, regardless of configuration, flexible core section 52 is constructed from suitable material so as to be easily bent into a desired shape by applying pressure from one's fingers, such shape advantageously being retained by the electromagnet.

Prior to winding, flexible core section 52 is preferably coated with a covering layer such as a conformal coating, an elastomer coating, a tape such as a polyester tape, or the like. This covering serves to prevent abrasion of the wire by the core section, especially as the assembled electromagnet is flexed. The covering further serves to absorb some stress exerted by the winding, especially at sharp bends in the electromagnet.

Figure 4:
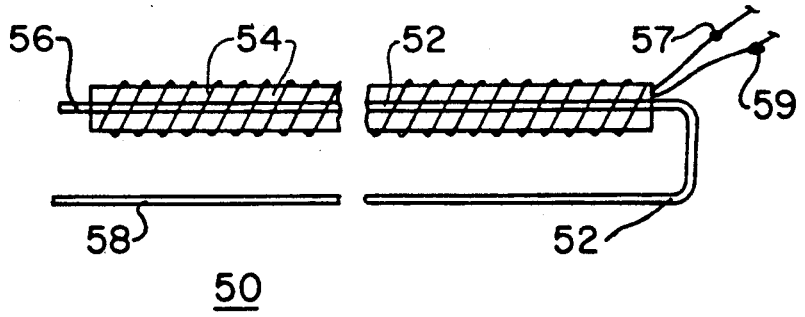
FIG. 4 is a side elevation view of the flex core employed in the device of FIG. 1.

Wire winding 54 of flexible electromagnet 50 comprises a plurality of wire turns formed on the covered flexible core section 52. Although FIGS. 2–4 depict a gap between the individual turns for ease of illustration, it is desirable in practice to closely wind turns onto the core member in order to maximize magnetic flux. The wire winding comprises a winding of insulated electromagnet wire which is wound on the flexible core section. The two ends of the wire are attached to two wire leads 57, 59 which are coupled to the line to be monitored for fault and/or status signals. Any suitable winding technique may be employed, with an alternating end-to-end back and forth winding being preferable. Wire winding 54 is advantageously wound onto flexible core section 52 by automated winding equipment as core section is in a straight, extended position, i.e., prior to being bent into a U-shaped to be fit into base 10 and housing 20. The number of turns and the type of insulated wire will depend on a variety of factors, including the type of permanent magnet indicator display employed, relative position of the two pole pieces and the indicator display, type of material employed as the flexible core section, voltage and current to be supplied to the winding, resistance of the permanent magnet to rotation as well as other factors. In the illustrative embodiment of FIGS. 1-4, 6,300 turns of AWG #44 wire are wrapped onto approximately one-half of the length of flexible core section 52 and presents a resistance of approximately 350 ohms at 25° C. In this embodiment, a typical voltage of approximately 3.5 VDC will trip the indicator, i.e., cause the indicator to change from one state to another. As will be appreciated by one skilled in the art, once the indicator is set, it may be reset, and vice versa, by reversing the polarity of the voltage supplied to wire winding 54.

Figure 5:
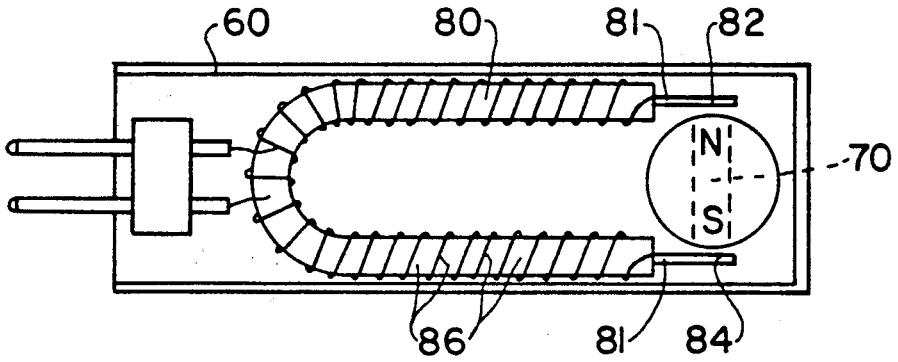
FIG. 5 is a perspective view of a second embodiment of the invention incorporating an entirely wound U-shaped flex core.

Referring now to FIG. 5, a second embodiment of the invention is depicted comprising housing 60, a rotatable permanent magnet 70 and an electromagnet 80.

Figure 2:
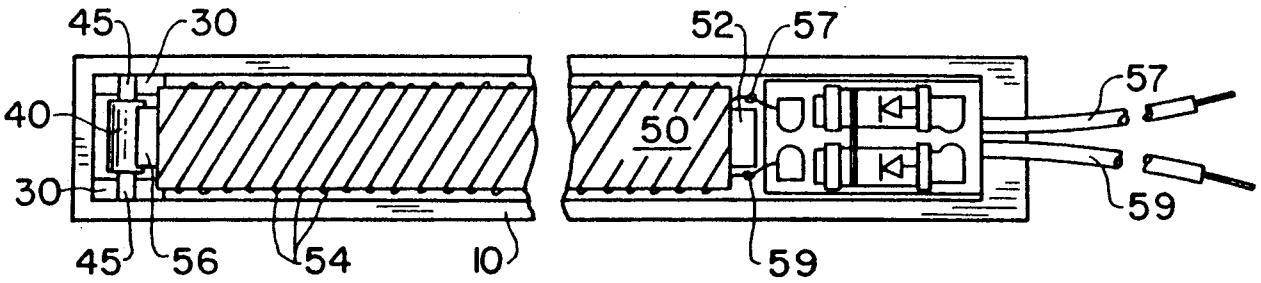
FIG. 2 is a top view of the device of FIG. 1.

Housing 60 is similar in structure and function to housing 20 of FIGS. 1-3. Permanent magnet 70 is an axially polarized magnet rotatably mounted in housing 20. Absent activation of electromagnet 80, permanent magnet 70 will tend to align its North pole and its South pole with the two pole pieces 82,84 of electromagnet 80. Since the device will align pole piece 82 with the North pole of permanent magnet 70 and pole piece 84 with the South pole piece of permanent magnet 70 as easy as it will tend to align pole piece 82 with the South pole of permanent magnet 70 and pole piece 84 with the North pole piece of permanent magnet 70, separate means (not shown) may be provided to favor one such orientation. Such separate means may comprise a spring biasing means. Alternatively, correct orientation could be ensured at the place of manufacture. The device will then tend to retain such orientation until a fault or change in status is indicated which energizes electromagnet 80 and rotates permanent magnet 70 by approximately 180°. As one skilled in the art will appreciate, the device may be reset to indicate a no-fault or change in status condition by momentarily applying a reverse polarity electrical pulse to electromagnet 80. Such a reverse polarity electrical pulse will be an electrical pulse of polarity opposite the electrical signal which caused the indicator to indicate a fault or change in status. Flags or similar colored means such as that disclosed in the aforementioned U.S. Pat. Nos. 3,704,462, 4,115,769 and 4,652,868 may be employed to provide a visual indication of the status of the monitored line.

Figure 6:
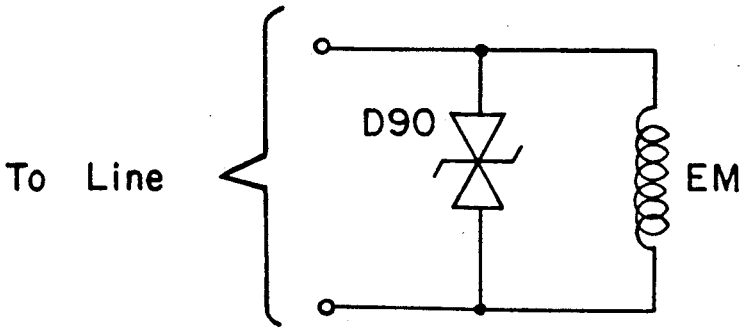
FIG. 6 is a schematic circuit diagram of a transient protection circuit.

Electromagnet 80 of FIG. 5 comprises a flexible core section 81 and a wire winding 86. Flexible core section 35 81 is similar to flexible core section 52 of FIGS. 1-4. Wire winding 86 is similar to wire winding 54 of FIGS. 1-4, except that wire winding 86 extends from one end of core section 81 to the other end. Referring now to FIG. 6, there is depicted in detail the transient protection circuit of FIGS. 1-4 for use with the present invention. The transient protection circuit comprises a zener diode D90 connected in parallel with the electromagnet (designated as EM in FIG. 6) of the present invention and across which is connected the line to be monitored. The zener diode illustratively is a 6 volt zener diode. As is apparent, the zener diode functions to suppress transient surges created by the inductance of the wire coil on the line, thereby reducing the risk of harm to any input circuitry that may be connected to the line.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the flexible electromagnet disclosed and claimed herein is not limited to use in fault indicators or status indicators but may be employed wherever electromagnets are used. Furthermore, the flexible core section of the electromagnet is not limited to a single elongated member which may be bent into any of a number of configurations but may take on the form of Y-shaped and X-shaped configurations as well as complex shapes. In addition, separate or a common wire winding(s) may be provided on the various extensions or legs of the configuration in accordance with desired design parameters. For example, a plurality of independent wire coils may be provided on a plurality of such legs thereby creating a plurality of pole pieces. Alternatively, a single wire length may be wound onto the legs, with the two ends of the wire coupled to a channel having two terminals. Furthermore, two of such single wire lengths may be wound onto the legs, with the ends of each single wire length remaining separate from each other. Alternatively, a single wire length having two ends and a center tap (or a plurality of center taps) may be employed and connected to a channel having three (or more) terminals. Additionally, any combination of the above wire winding configurations as well as others, may be employed in a single electromagnet.

What is claimed is:

1. An indicating device for monitoring an electrical channel and providing an indication of a status change signal on said channel comprising:

a flexible magnetically permeable elongated core means for transmitting magnetic flux and having a plurality of magnetic pole pieces, said core means being adapted to have wound thereon a continuous winding along the entire length of said core means from a first magnetic pole piece to a second magnetic pole piece;

coil means for creating magnetic flux, said coil means connectable to said channel to be monitored, said coil means having a plurality of wire turns formed on said core means so as to form an electromagnet;

a permanent magnet operatively associated with said core means and said coil means and responsive to energization of said coil means, said energization resulting from detection of a status change signal on said channel to be monitored; and housing means for housing said core means and said coil means, wherein said electromagnet is sufficiently flexible along its entire length to enable said electromagnet to be bent anywhere along its entire length from said first magnetic pole piece to said second magnetic pole piece into a desired configuration by the application of finger pressure so as to selectively direct magnetic flux emanating from any of said magnetic pole pieces to a desired location, said electromagnet retaining said desired configuration.

2. The indicating device of claim 1, further comprising a covering layer on said core means and disposed between said core means and said coil means.

3. The indicating device of claim 1, wherein said coil means is a single wire which is wound onto said core member and forms a number of wire turns.

4. The indicating device of claim 3, wherein said coil means is wound onto approximately one-half of the entire length of said core member.

5. The indicating device of claim 3, wherein said coil means is wound onto approximately the entire length of said core member.

6. The indicating device of claim 3, further comprising a zener diode connected in parallel with said coil means, said zener diode forming a transient surge suppression network.

7. The indication device of claim 1, wherein said core means is constructed from cold rolled steel which has been annealed to increase flexibility of said core means.

8. The indicating device of claim 1, wherein said permanent magnet is diametrically polarized and axially rotatably mounted so as to rotate with respect to said electromagnet.

9. The indicating device of claim 8, wherein said diametrically polarized permanent magnet is constructed from barium ferrite.

10. The indicating device of claim 8, wherein said first pole piece and said second pole piece are positioned on opposite sides of said permanent magnet.

11. The indicator device of claim 1 wherein said channel to be monitored is a power supply.

12. An indicator device for monitoring an electrical channel and providing an indication of a status change signal on said channel comprising:

a flexible magnetically permeable elongated core member having a first magnetic pole piece located at one end of said core member and a second magnetic pole piece located at an opposite end of said core member;

a coil of wire wound onto at least a portion of said core member thereby forming an electromagnet, said coil of wire terminating in two wire leads, said wire leads connectable to said channel to be monitored so as to provide for detection of said status change signal;

a permanent magnet operatively associated with said core and said coil and in communication with said core and said coil by way of magnetic flux and responsive to energization of said coil, said energization resulting from detection of said status change signal, and said energization causing rotation of said permanent magnet and indicating the existence of said status change signal; and housing means for housing said core member, said coil of wire and said permanent magnet, wherein said core member is in the form of a U-shaped member with said first magnetic pole piece and said second magnetic pole piece positioned on opposite sides of said permanent magnet, and wherein said core and said coil are sufficiently flexible along their entire length so as to enable said core and said coil to be bent anywhere along their entire lengths from said first magnetic pole piece to said second magnetic pole piece into said U-shaped configuration from a straight configuration by the application of finger pressure so as to selectively direct magnetic flux emanating from one of said magnetic pole pieces through said permanent magnet and into the other magnetic pole piece so as to produce rotation of said permanent magnet upon detection of said status change signal.

13. The indicator device of claim 12, further comprising a zener diode connected to said two wire leads and in parallel with said coil of wire, said zener diode forming a transient surge suppression network.

14. The indicator device of claim 12, further comprising a covering layer on said core member and disposed between said core member and said coil of wire.

15. The indicator device of claim 12, wherein said coil of wire is wound onto approximately one-half of the entire length of said core member.

16. The indicator device of claim 12, wherein said coil of wire is wound onto approximately the entire length of said core member.

17. The indicator device of claim 12, wherein said core member is constructed from cold rolled steel which has been annealed to increase flexibility of said core member.

18. The indicator device of claim 12, wherein said permanent magnet is axially polarized and rotatably mounted so as to rotate with respect to said core and said coil.

19. The indicator device of claim 18, wherein said axially polarized permanent magnet is constructed from barium ferrite.

20. The indicator device of claim 12 wherein said channel to be monitored is a power supply.

* * * * *